US011776771B2

(12) United States Patent
Kao

(10) Patent No.: US 11,776,771 B2
(45) Date of Patent: Oct. 3, 2023

(54) PROTECTION STRUCTURE OF FUSE LINK SWITCH

(71) Applicant: GOODWELL ELECTRIC CORPORATION, Taipei (TW)

(72) Inventor: Sui-Chan Kao, Taoyuan (TW)

(73) Assignee: GOODWELL ELECTRIC CORPORATION, Taipei (TW)

( * ) Notice: Subject to any disclaimer, the term of this patent is extended or adjusted under 35 U.S.C. 154(b) by 0 days.

(21) Appl. No.: 17/842,467

(22) Filed: Jun. 16, 2022

(65) Prior Publication Data

US 2023/0238195 A1 Jul. 27, 2023

(30) Foreign Application Priority Data

Jan. 26, 2022 (TW) ..... 111201029

(51) Int. Cl.
*H01H 9/10* (2006.01)

(52) U.S. Cl.
CPC ..... *H01H 9/102* (2013.01); *H01H 9/104* (2013.01)

(58) Field of Classification Search
CPC ..... H01H 9/102; H01H 9/104
USPC ..... 337/9
See application file for complete search history.

(56) References Cited

U.S. PATENT DOCUMENTS 2,630,508 A * 3/1953 Meisenheimer ..... H01H 31/125 337/217
2,692,315 A * 10/1954 Hubbard ..... H01H 31/127 337/167
2,734,964 A * 2/1956 Edwards et al. ..... 337/180
3,041,426 A * 6/1962 Baker ..... H01H 31/127 337/250
4,546,341 A * 10/1985 McNaghten ..... H01H 31/125 337/217
4,768,010 A * 8/1988 Brown ..... H01H 31/127 361/115
6,922,132 B2 * 7/2005 Montante ..... H01H 31/127 337/171
7,532,103 B2 * 5/2009 Almgren ..... H01H 31/127 337/171
9,349,501 B2 * 5/2016 Miyamoto ..... H01H 33/64
10,818,407 B2 * 10/2020 Di-Gianni ..... H01B 3/40

FOREIGN PATENT DOCUMENTS

CN 201498465 U * 6/2010

OTHER PUBLICATIONS

CN-201498465-U—English translation (Year: 2010).*

* cited by examiner

*Primary Examiner* — Anatoly Vortman

(57) ABSTRACT

A protection structure is disclosed and is applied in a fuse link switch. The fuse link switch comprises: an insulator, a fuse tube including an upper connection portion and a lower connection portion, an upper-end fixing unit, a lower-end fixing unit, and a toggle mechanism, wherein the upper connection portion is connected with a pull hook. The protection structure comprises at least one electrically insulating shielding layer covering at least one of the upper-end fixing unit, the pull hook, the upper connection portion, the lower connection portion, the lower-end fixing unit, and the toggle mechanism through overmolding technique.

5 Claims, 12 Drawing Sheets

PROTECTION STRUCTURE OF FUSE LINK SWITCH

BACKGROUND OF THE INVENTION

1. Field of the Invention

The present invention relates to the technology field of fuse link switch, and more particularly to a protection structure of fuse link switch.

2. Description of the Prior Art

It is well known that fuse link switches are applied in a power system to protect the system's equipment from overload and/or short circuits. A fuse link switch commonly comprises: an insulator, a fuse tube, an upper-end fixing unit, an upper-end conductor connecting unit, a conductive plate spring, a lower-end fixing unit, a lower-end conductor connecting unit, a toggle mechanism, and a mounting bracket. Particularly, an upper cover is adopted for semi-enclosing the upper-end fixing unit and the upper-end conductor connecting unit, and a lower cover is adopted for semi-enclosing the lower-end fixing unit and the lower-end conductor connecting unit. By such arrangements, the upper cover and the lower cover prevent birds from being electrocuted and also protect kites and branches from coming into contact with the fuse link.

However, the conventional fuse link switch still shows a few drawbacks in practical use. The drawbacks are summarized as follows.

(1) Despite both the upper cover and the lower cover being semi-closed housings, there is still a risk of birds being electrocuted and kites and branches coming into contact with the conductive articles covered by the upper cover and/or the lower cover.

(2) Because being covered by the upper cover, it is hard for the engineering staff to control a load break tool to connect a pull ring and/or a pull hook of the fuse tube. Moreover, it is worth mentioning that, during using the load break tool to directly pull the fuse tube to drop out, electric arc is produced between the conductive plate spring and the first electrical connecting element.

(3) The upper cover and the lower cover are commonly both a polyhedron having an accommodation space, such that the upper cover fails to comprehensively contact the upper-end fixing unit and the upper-end conductor connecting unit. Likewise, the lower cover also fails to comprehensively contact the lower-end fixing unit and the lower-end conductor connecting unit.

According to the above descriptions, it is understood that there is room for improvement in the conventional fuse link switch. In view of that, the inventor of the present application has made great efforts to make inventive research and eventually provided a protection structure of fuse link switch.

SUMMARY OF THE INVENTION

The primary objective of the present invention is to disclose a protection structure for being applied in a fuse link switch. The fuse link switch comprises: an insulator, a fuse tube including an upper connection portion and a lower connection portion, an upper-end fixing unit, a lower-end fixing unit, and a toggle mechanism, wherein the upper connection portion is connected with a pull hook. The protection structure comprises at least one electrically insulating shielding layer covering at least one of the upper-end fixing unit, the pull hook, the upper connection portion, the lower connection portion, the lower-end fixing unit, and the toggle mechanism through overmolding technique.

For achieving the primary objective mentioned above, the present invention provides an embodiment of the protection structure, which is applied in a fuse link switch. The fuse link switch comprises: an insulator, a fuse tube including an upper connection portion and a lower connection portion, an upper-end fixing unit, a lower-end fixing unit including a lower-end conductor connecting member, and a toggle mechanism, wherein the upper connection portion is connected with a pull hook. Said protection structure is characterized in that: comprising at least one electrically insulating shielding layer covering at least one of the upper-end fixing unit, the pull hook, the upper connection portion, the lower connection portion, the lower-end fixing unit, the lower-end conductor connecting member, and the toggle mechanism, wherein the at least one electrically insulating shielding layer is made of an electrically insulation material.

In one embodiment, the electrically insulation material is silicone rubber.

In one embodiment, the at least one electrically insulating shielding layer is formed to cover at least one of the upper-end fixing unit, the pull hook, the upper connection portion, the lower connection portion, the lower-end fixing unit, the lower-end conductor connecting member, and the toggle mechanism through overmolding technique.

In one practicable embodiment, the at least one electrically insulating shielding layer overall covers at least one of the upper-end fixing unit, the pull hook, the upper connection portion, the lower connection portion, the lower-end fixing unit, the lower-end conductor connecting member, and the toggle mechanism through overmolding technique.

In another one practicable embodiment, the at least one electrically insulating shielding layer locally covers at least one of the upper-end fixing unit, the pull hook, the upper connection portion, the lower connection portion, the lower-end fixing unit, the lower-end conductor connecting member, and the toggle mechanism through overmolding technique.

In one embodiment, the electrically insulating shielding layer locally covers the pull hook, such that at least one part of the pull hook is not covered by the electrically insulating shielding layer.

In one embodiment, the insulator is made of a material selected from a group consisting of polymer material and ceramic material.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a protection structure of fuse link switch according to the present invention, embodiments of the present invention will be described in detail with reference to the attached drawings hereinafter.

Figure 1:
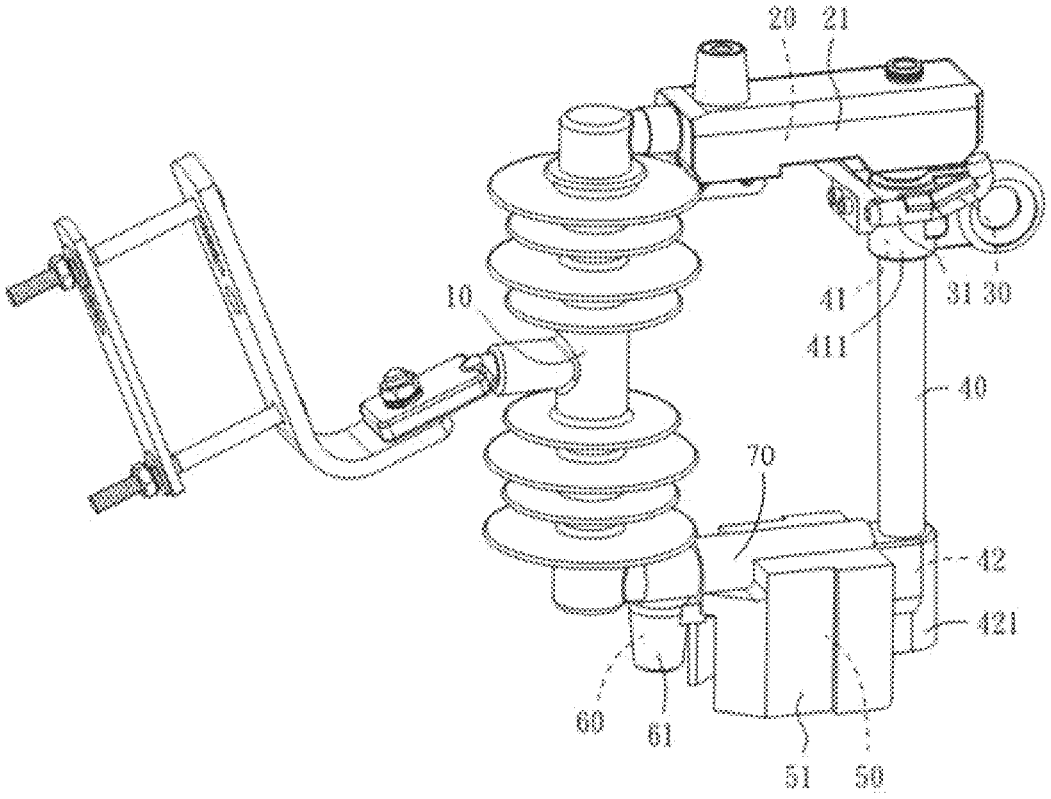
FIG. 1 shows a stereo diagram of a fuse link switch including a protection structure according to the present invention.

With reference to FIG. 1, there is shown a stereo diagram of a fuse link switch including a protection structure according to the present invention. As FIG. 1 shows, the fuse link switch comprises: an insulator 10, a fuse tube 40 including an upper connection portion 41 and a lower connection portion 42, an upper-end fixing unit 20, a lower-end fixing unit 50 including a lower-end conductor connecting member 60, and a toggle mechanism 70, wherein the upper connection portion 41 is connected with a pull hook 30. The present invention discloses a protection structure, which comprises at least one electrically insulating shielding layer covering at least one of the upper-end fixing unit 20, the pull hook 30, the upper connection portion 41, the lower connection portion 42, the lower-end fixing unit 50, the lower-end conductor connecting member 60, and the toggle mechanism 70. For example, FIG. 1 depicts that the protection structure comprises: a first electrically insulating shielding layer 21, a second electrically insulating shielding layer 31, a third electrically insulating shielding layer 411, a fourth electrically insulating shielding layer 421, a fifth electrically insulating shielding layer 51, and a sixth electrically insulating shielding layer 61. In one embodiment, the at least one electrically insulating shielding layer (21, 31, 411, 421, 51, 61) is made of an electrically insulation material such as silicone rubber.

When producing the protection structure, the at least one electrically insulating shielding layer (21, 31, 411, 421, 51, 61) is formed to cover at least one of the upper-end fixing unit 20, the pull hook 30, the upper connection portion 41, the lower connection portion 42, the lower-end fixing unit 50, the lower-end conductor connecting member 60, and the toggle mechanism 70 through overmolding technique.

Figure 2A:
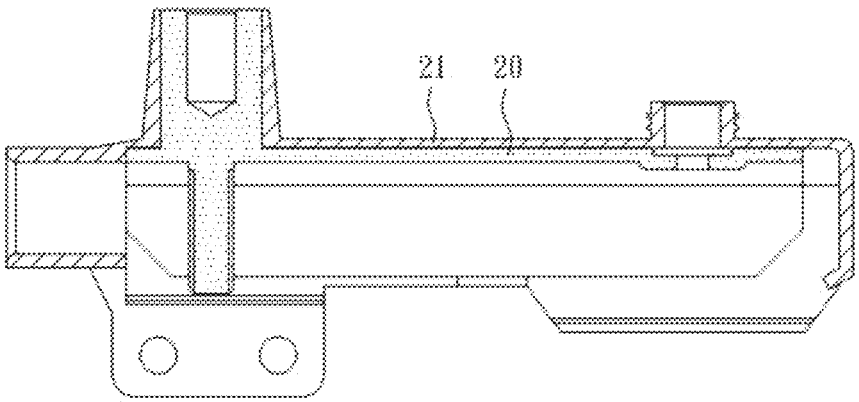
FIG. 2A shows a cross-sectional view of an upper-end fixing unit that is shown in FIG. 1.
Figure 2B:
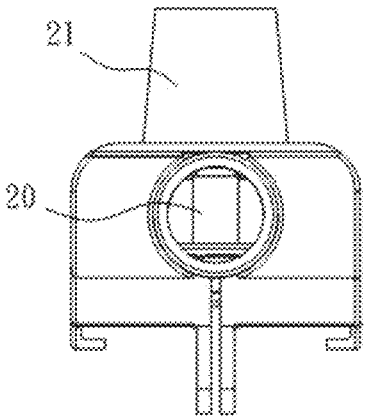
FIG. 2B shows a left view of the upper-end fixing unit.
Figure 2C:
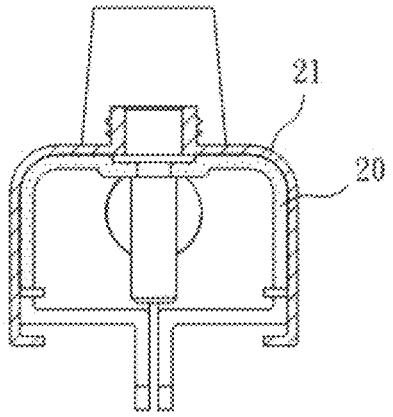
FIG. 2C shows a right view of the upper-end fixing unit.

With reference to FIG. 2A, there is shown a cross-sectional view of the upper-end fixing unit 20 shown in FIG. 1. Moreover, FIG. 2B shows a left view of the upper-end fixing unit 20, and FIG. 2C shows a right view of the upper-end fixing unit 20. FIGS. 2A-2C depict that the protection structure comprises a first electrically insulating shielding layer 21 formed to cover the upper-end fixing unit 20 of the fuse link switch through overmolding technique.

Figure 3A:
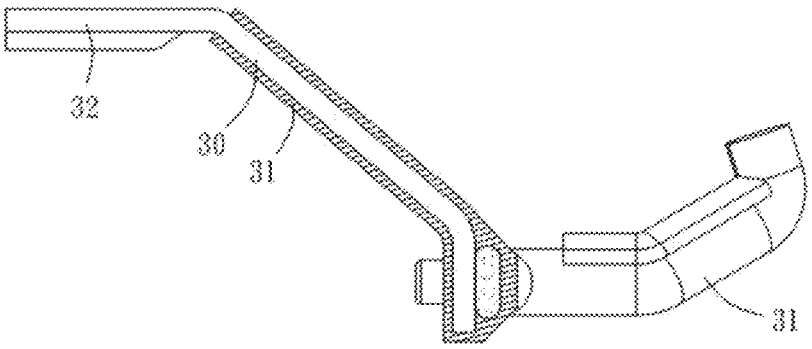
FIG. 3A shows a first cross-sectional view of a pull hook that is shown in FIG. 1.
Figure 3B:
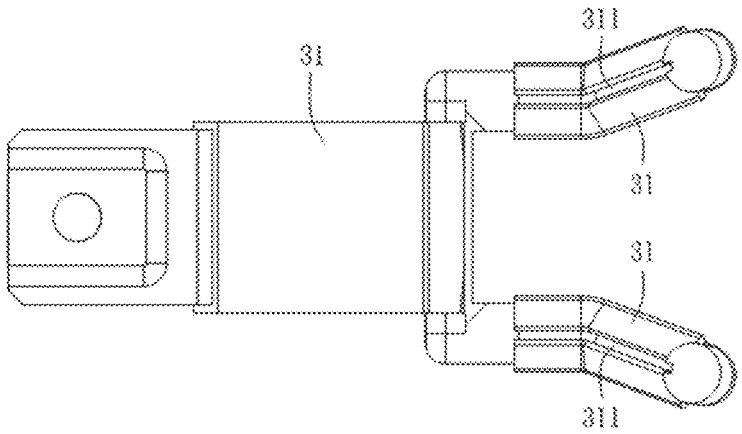
FIG. 3B shows a top view of the pull hook.
Figure 3C:
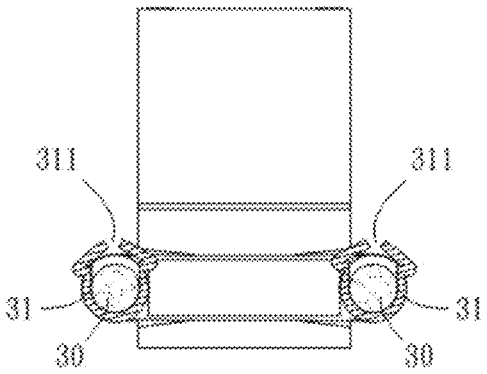
FIG. 3C shows a second cross-sectional view of the pull hook.

Furthermore, FIGS. 3A-3C show a first cross-sectional view, a top view and a second cross-sectional view of the pull hook 30 that is shown in FIG. 1. According to FIGS. 3A-3C, it is clear that the protection structure further comprises a second electrically insulating shielding layer 31, which is formed so as to locally cover the pull hook 30 through overmolding technique. It is worth noting that, FIGS. 3A-3C also depict that a connection member 32 of the pull hook 30 is not covered by the electrically insulating shielding layer. In other words, the connection member 32 of the pull hook is exposed out of the second electrically insulating shielding layer 31. Moreover, the second electrically insulating shielding layer 31 is provided with two groove openings 311 thereon.

Figure 4A:
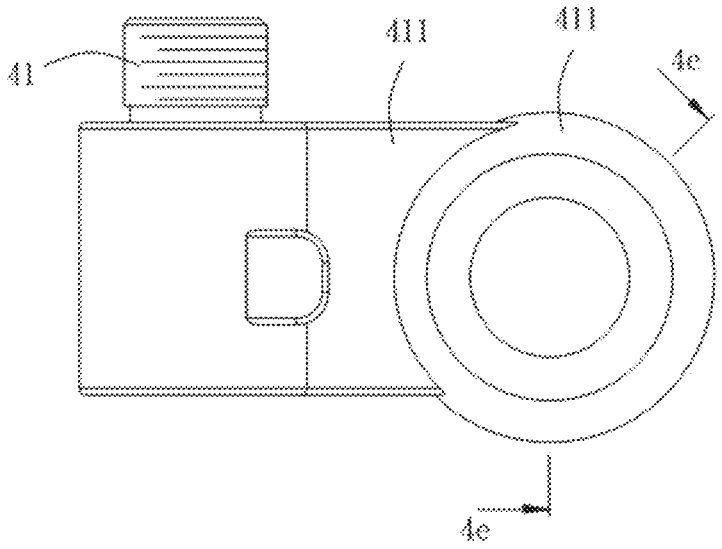
FIG. 4A shows a front view of an upper connection portion of a fuse tube that is shown in FIG. 1.
Figure 4B:
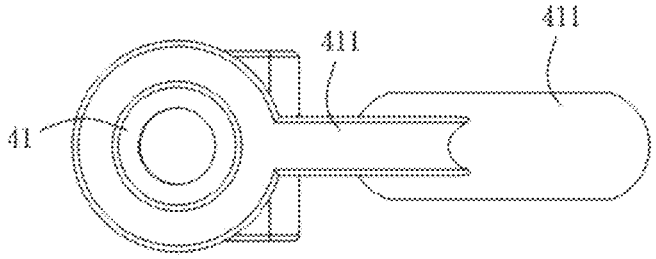
FIG. 4B shows a top view of the upper connection portion.
Figure 4C:
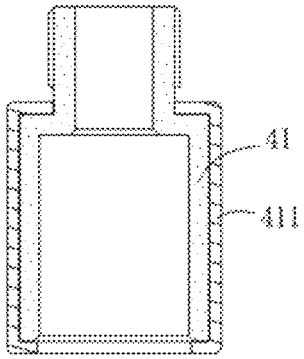
FIG. 4C shows a first cross-sectional view the upper connection portion.
Figure 4D:
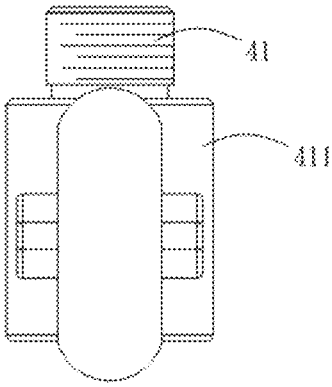
FIG. 4D shows a right view the upper connection portion.
Figure 4E:
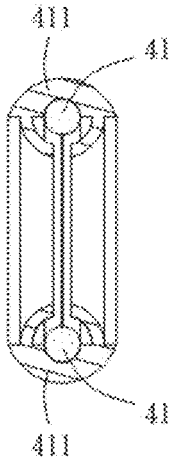
FIG. 4E shows a second cross-sectional view the upper connection portion.

With reference to FIG. 4A, there is shown a front view of the upper connection portion 41 of the fuse tube 40 shown in FIG. 1. Moreover, FIGS. 4B-4E show a top view, a first cross-sectional view, a right view, and a second cross-sectional view of the upper connection portion 41. According to FIGS. 4A-4E, it is clear that the protection structure further comprises a third electrically insulating shielding layer 411 formed to overall cover the upper connection portion 41 of the fuse tube 40 through overmolding technique.

Figure 5A:
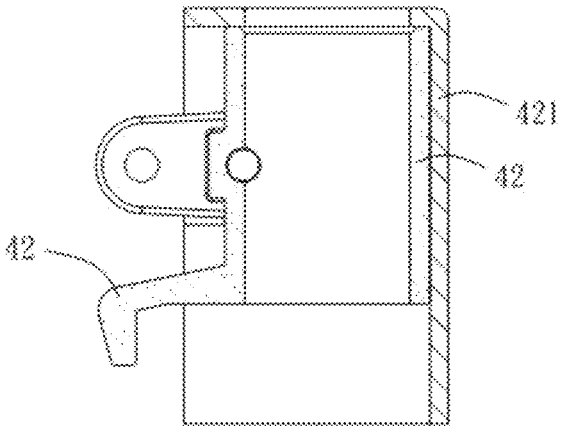
FIG. 5A shows a first cross-sectional view of a lower connection portion of the fuse tube that is shown in FIG. 1.
Figure 5B:
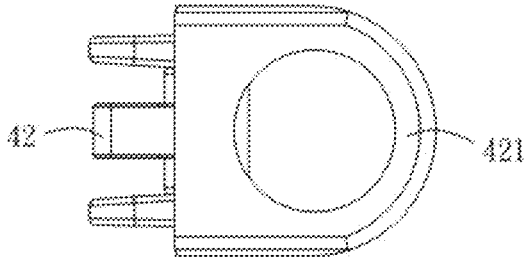
FIG. 5B shows a top view of the lower connection portion.
Figure 5C:
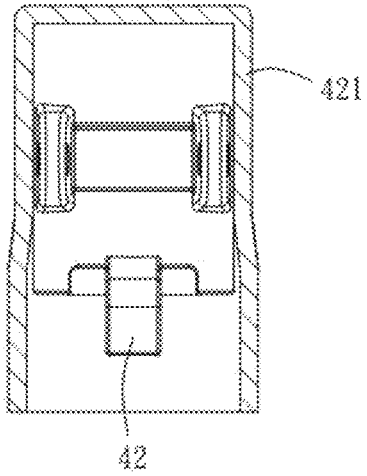
FIG. 5C shows a second cross-sectional view of the lower connection portion.
Figure 5D:
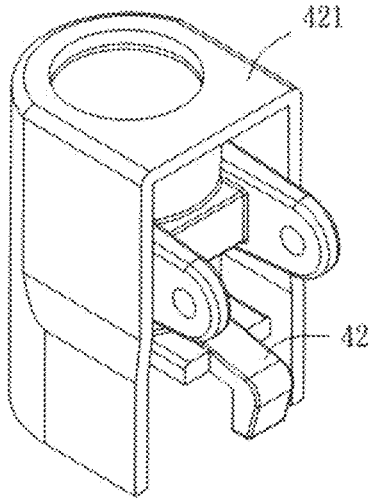
FIG. 5D shows a stereo diagram of the lower connection portion.

In addition, FIG. 5A illustrates a first cross-sectional view of the lower connection portion 42 of the fuse tube 40 that is shown in FIG. 1. Moreover, FIGS. 5B-5D show a top view, a second cross-sectional view, and a three dimensional view of the lower connection portion 42. According to FIGS. 5A-5D, it is clear that the protection structure further comprises a fourth electrically insulating shielding layer 421 formed to locally cover the lower connection portion 42 of the fuse tube 40 through overmolding technique.

Figure 6A:
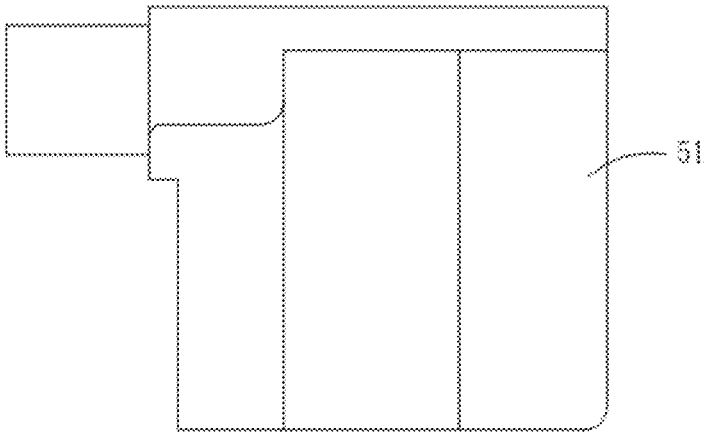
FIG. 6A shows a front view of a lower-end fixing unit and a toggle mechanism that is shown in FIG. 1.
Figure 6B:
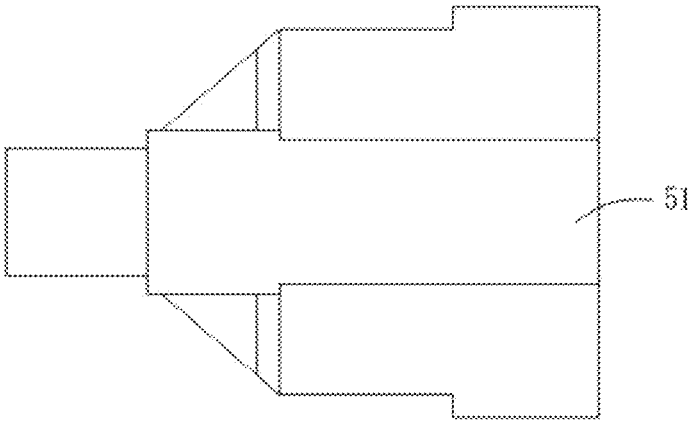
FIG. 6B shows a top view of the lower-end fixing unit and the toggle mechanism.
Figure 6C:
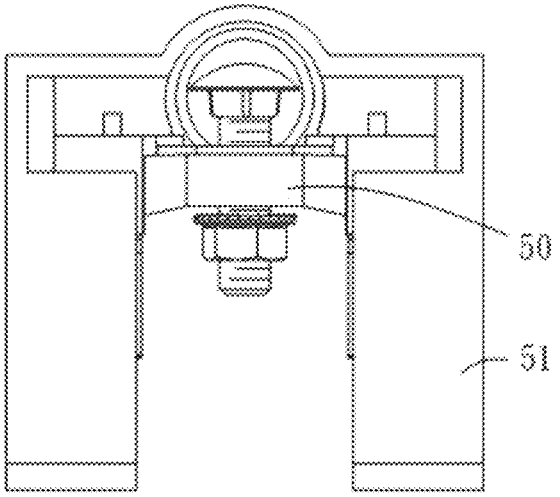
FIG. 6C shows a right view of the lower-end fixing unit and the toggle mechanism.
Figure 6D:
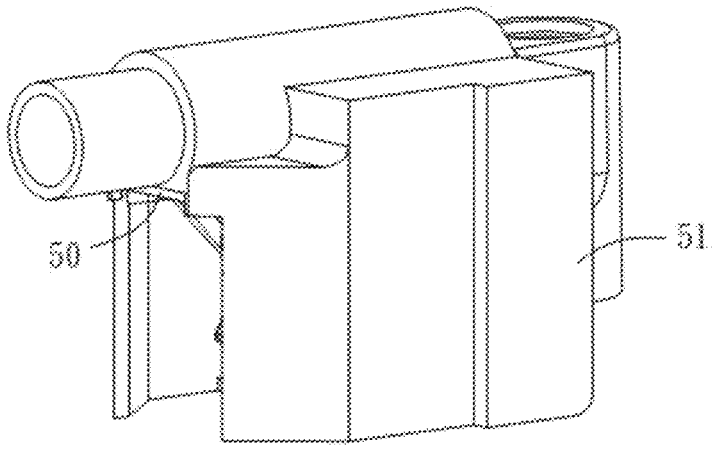
FIG. 6D shows a stereo diagram of the lower-end fixing unit and the toggle mechanism.

With reference to FIG. 6A, there is shown a front view of the lower-end fixing unit 50 and the toggle mechanism 70 that is shown in FIG. 1. Moreover, FIGS. 6B-6D show a top view, a right view and a three dimensional view of the lower-end fixing unit 50 and the toggle mechanism 70. According to FIGS. 6A-6D, it is clear that the protection structure further comprises a fifth electrically insulating shielding layer 51 formed to locally cover the lower-end fixing unit 50 and the toggle mechanism 70 through overmolding technique.

Figure 7A:
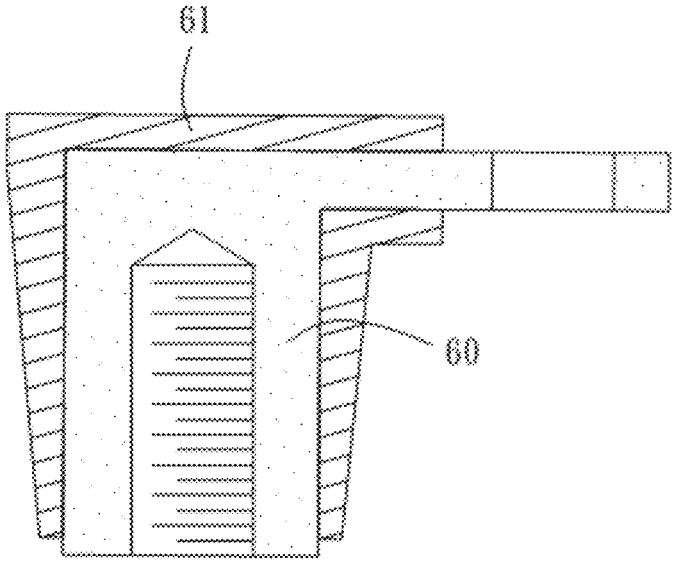
FIG. 7A shows a cross-sectional view of a lower-end conductor connecting member of the lower-end fixing unit is shown in FIG. 1.
Figure 7B:
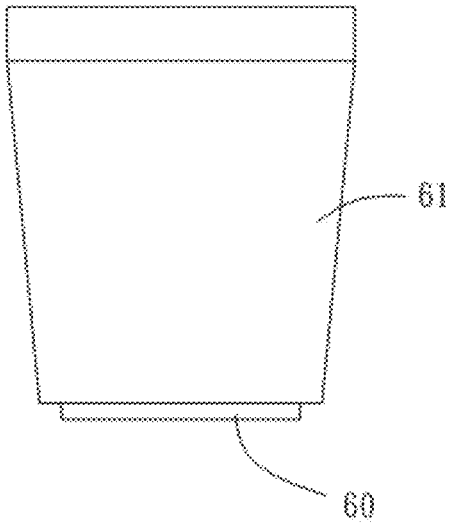
FIG. 7B shows a left view of the lower-end conductor connecting member.

Besides, FIG. 7A shows a cross-sectional view of the lower-end conductor connecting member 60 of the lower-end fixing unit 50 is shown in FIG. 1. Moreover, FIG. 7B shows a left view of the lower-end conductor connecting member 60. According to FIGS. 7A-7B, it is clear that the protection structure further comprises a sixth electrically insulating shielding layer 61 formed to overall cover the lower-end conductor connecting member 60 through overmolding technique.

Therefore, through above descriptions, all embodiments and their constituting elements of the protection structure of the fuse link switch proposed by the present invention have been introduced completely and clearly; in summary, the present invention includes the advantages of:

(1) By forming at least one electrically insulating shielding layer (21, 31, 411, 421, 51, 61) to cover at least one of the upper-end fixing unit 20, the pull hook 30, the upper connection portion 41, the lower connection portion 42, the lower-end fixing unit 50, the lower-end conductor connecting member 60, and the toggle mechanism 70 through overmolding technique, the protection structure prevents birds from being electrocuted and also protects kites and branches from coming into contact with the fuse link switch.

(2) Because the at least one electrically insulating shielding layer (21, 31, 411, 421, 51, 61) is formed through overmolding technique, any one of the upper-end fixing unit 20, the pull hook 30, the upper connection portion 41, the lower connection portion 42, the lower-end fixing unit 50, the lower-end conductor connecting member 60, and the toggle mechanism 70 still has appearance consistency.

(3) The at least one electrically insulating shielding layer (21, 31, 411, 421, 51, 61) has a specific layer thickness, such that any one of the upper-end fixing unit 20, the pull hook 30, the upper connection portion 41, the lower connection portion 42, the lower-end fixing unit 50, the lower-end conductor connecting member 60, and the toggle mechanism 70 is protected from external impact.

The above description is made on embodiments of the present invention. However, the embodiments are not intended to limit the scope of the present invention, and all equivalent implementations or alterations within the spirit of the present invention still fall within the scope of the present invention.

What is claimed is:

1. A protection structure, being applied in a fuse link switch comprising an insulator, a fuse tube including an upper connection portion and a lower connection portion, an upper-end fixing unit, a lower-end fixing unit including a lower-end conductor connecting member, and a toggle mechanism, wherein the upper connection portion is connected with a pull hook;

characterized in that said protection structure comprises at least one electrically insulating shielding layer covering at least one of the upper-end fixing unit, the pull hook, the upper connection portion, the lower connection portion, the lower-end fixing unit, the lower-end conductor connecting member, and the toggle mechanism, wherein the at least one electrically insulating shielding layer is made of an electrically insulation material;

wherein one side of the pull hook is a connection member that is not covered by the electrically insulating shielding layer and the electrically insulating shielding layer of the pull hook is provided with two groove openings.

2. The protection structure of claim 1, wherein the electrically insulation material is silicone rubber.

3. The protection structure of claim 1, wherein the at least one electrically insulating shielding layer covers at least one of the upper-end fixing unit, the pull hook, the upper connection portion, the lower connection portion, the lower-end fixing unit, the lower-end conductor connecting member, and the toggle mechanism through overmolding technique.

4. The protection structure of claim 1, wherein the electrically insulating shielding layer locally covers the pull hook, such that at least one part of the pull hook is not covered by the electrically insulating shielding layer.

5. The protection structure of claim 1, wherein the insulator is made of a material selected from a group consisting of polymer material and ceramic material.

* * * * *